US011524827B2

(12) United States Patent
Gungner

(10) Patent No.: US 11,524,827 B2
(45) Date of Patent: Dec. 13, 2022

(54) CARRIER, BLANK, AND METHOD OF FORMING A CARRIER

(71) Applicant: Graphic Packaging International, LLC, Atlanta, GA (US)

(72) Inventor: Greg Gungner, Ontario (CA)

(73) Assignee: Graphic Packaging International, LLC, Atlanta, GA (US)

( * ) Notice: Subject to any disclaimer, the term of this patent is extended or adjusted under 35 U.S.C. 154(b) by 407 days.

(21) Appl. No.: 16/442,865

(22) Filed: Jun. 17, 2019

(65) Prior Publication Data

US 2019/0389639 A1 Dec. 26, 2019

Related U.S. Application Data

(60) Provisional application No. 62/687,480, filed on Jun. 20, 2018.

(51) Int. Cl.
*B65D 71/38* (2006.01)

(52) U.S. Cl.
CPC .... *B65D 71/38* (2013.01); *B65D 2571/00141* (2013.01); *B65D 2571/00716* (2013.01)

(58) Field of Classification Search
CPC ..... B65D 71/38; B65D 2571/00141; B65D 2571/00716
USPC ..... 229/103.2, 103.3, 87.01, 87.04, 87.05, 229/185.1, 122; 206/784, 427, 429
See application file for complete search history.

(56) References Cited

U.S. PATENT DOCUMENTS 2,005,991 A * 6/1935 Gagen ..... B65D 5/0254 229/103.2
2,718,997 A 9/1955 Shuxteau
2,849,111 A 8/1958 Fielding
2,904,170 A * 9/1959 Hennessey ..... B65D 77/0433 206/784
2,917,166 A * 12/1959 Lidgard ..... B65D 85/48 206/448
2,922,561 A 1/1960 Currivan
2,928,541 A 3/1960 Fielding
3,178,242 A 4/1965 Ellis
3,300,115 A 1/1967 Schauer
(Continued)

FOREIGN PATENT DOCUMENTS

BE 671.762 3/1966
DE 91 04 905.9 6/1991
(Continued)

OTHER PUBLICATIONS

International Search Report and Written Opinion for PCT/US2019/037441 dated Oct. 4, 2019.
(Continued)

*Primary Examiner* — Jacob K Ackun
(74) *Attorney, Agent, or Firm* — Womble Bond Dickinson (US) LLP

(57) ABSTRACT

A blank for forming a carrier for holding at least one article includes a plurality of panels that includes a first main panel foldably connected to a second main panel. The first main panel includes a top panel portion foldably connected to at least one top side panel portion, and the second main panel comprises a bottom panel portion foldably connected to at least one bottom side panel portion. The blank further includes at least one handle feature for forming a handle.

28 Claims, 5 Drawing Sheets

(56) References Cited

U.S. PATENT DOCUMENTS

| | | | | |
|---|---|---|---|---|
| 3,306,519 | A | 2/1967 | Wood | |
| 3,339,723 | A | 9/1967 | Wood | |
| 3,356,279 | A | 12/1967 | Root | |
| 3,373,867 | A | 3/1968 | Wood | |
| 3,593,849 | A | 7/1971 | Helms | |
| 3,635,452 | A | 1/1972 | Helms | |
| 3,669,342 | A | 6/1972 | Funkhouser | |
| 3,747,835 | A | 7/1973 | Graser | |
| 3,767,042 | A | 10/1973 | Ganz | |
| 3,963,121 | A | 6/1976 | Kipp | |
| 4,010,593 | A | 3/1977 | Graham | |
| 4,101,069 | A | 7/1978 | Wood | |
| 4,202,446 | A | 5/1980 | Sutherland | |
| 4,328,893 | A | 5/1982 | Oliff et al. | |
| 4,394,903 | A | 7/1983 | Bakx | |
| 4,424,901 | A | 1/1984 | Lanier | |
| 4,440,340 | A | 4/1984 | Bakx | |
| 4,566,593 | A | 1/1986 | Muller | |
| 4,747,487 | A | 5/1988 | Wood | |
| 4,804,089 | A | 2/1989 | Wilson | |
| 4,875,585 | A | 10/1989 | Kadleck et al. | |
| 4,901,849 | A | 2/1990 | Wilson | |
| 4,919,266 | A | 4/1990 | McIntosh et al. | |
| 4,966,324 | A | 10/1990 | Steel | |
| 4,972,991 | A | 11/1990 | Schuster | |
| 5,000,313 | A | 3/1991 | Oliff | |
| 5,042,660 | A | 8/1991 | Carver | |
| 5,060,792 | A | 10/1991 | Oliff | |
| 5,131,588 | A | 7/1992 | Oliff | |
| 5,180,100 | A | 1/1993 | Shimizu | |
| 5,195,676 | A | 3/1993 | LeBras | |
| 5,246,112 | A | 9/1993 | Stout et al. | |
| 5,297,673 | A | 3/1994 | Sutherland | |
| 5,351,878 | A | 10/1994 | Cooper | |
| 5,421,458 | A | 6/1995 | Campbell | |
| 5,472,090 | A | 12/1995 | Sutherland | |
| 5,472,138 | A | 12/1995 | Ingram | |
| 5,485,915 | A | 1/1996 | Harris | |
| 5,505,372 | A | 4/1996 | Edson et al. | |
| 5,542,536 | A | 8/1996 | Sutherland | |
| 5,551,556 | A | 9/1996 | Sutherland | |
| 5,558,212 | A | 9/1996 | Sutherland | |
| 5,558,213 | A | 9/1996 | Sutherland | |
| 5,597,071 | A | 1/1997 | Sutherland | |
| 5,609,251 | A | 3/1997 | Harris | |
| 5,664,401 | A | 9/1997 | Portrait et al. | |
| 5,682,995 | A | 11/1997 | Sutherland | |
| 5,692,614 | A | 12/1997 | Harris | |
| 5,778,630 | A | 7/1998 | Portrait et al. | |
| 5,853,088 | A | 12/1998 | Saulas et al. | |
| 5,855,318 | A | 1/1999 | Baxter | |
| 5,931,300 | A | 8/1999 | Sutherland | |
| 5,937,620 | A | 8/1999 | Chalendar | |
| 5,941,453 | A | 8/1999 | Oliff | |
| 5,943,847 | A | 8/1999 | Chalendar | |
| 5,947,367 | A * | 9/1999 | Miller | B65D 71/36 229/182.1 |
| 5,975,286 | A | 11/1999 | Oliff | |
| 6,019,220 | A | 2/2000 | Sutherland | |
| 6,021,898 | A | 2/2000 | Sutherland | |
| 6,021,899 | A | 2/2000 | Sutherland | |
| 6,109,438 | A | 8/2000 | Sutherland | |
| 6,155,412 | A * | 12/2000 | Le Bras | B65D 71/30 206/199 |
| 6,155,480 | A | 12/2000 | Botsford et al. | |
| 6,158,586 | A | 12/2000 | Muller | |
| 6,227,367 | B1 | 5/2001 | Harrelson et al. | |
| 6,289,651 | B1 | 9/2001 | Le Bras | |
| 6,315,123 | B1 | 11/2001 | Ikeda | |
| 6,523,739 | B2 | 2/2003 | Heely et al. | |
| 6,550,616 | B2 | 4/2003 | Le Bras | |
| 6,612,482 | B2 * | 9/2003 | Ross | B65D 75/06 206/784 |
| 6,811,525 | B2 | 11/2004 | Culpepper | |
| 6,866,185 | B2 | 3/2005 | Harrelson | |
| 6,948,651 | B2 | 9/2005 | Ikeda | |
| 6,981,631 | B2 | 1/2006 | Fogle et al. | |
| 6,988,617 | B2 | 1/2006 | Gomes et al. | |
| 7,007,800 | B2 | 3/2006 | Le Bras | |
| 7,159,759 | B2 | 1/2007 | Sutherland | |
| 7,448,492 | B2 | 11/2008 | Sutherland | |
| 7,472,791 | B2 | 1/2009 | Spivey, Sr. | |
| 7,611,042 | B2 * | 11/2009 | Bates | B65D 5/0005 206/427 |
| 7,762,397 | B2 | 7/2010 | Coltri-Johnson et al. | |
| 9,199,774 | B2 | 12/2015 | Smalley et al. | |
| 9,380,914 | B2 | 7/2016 | Oblisk | |
| 10,233,001 | B2 * | 3/2019 | Furio | B65D 5/0005 |
| D854,412 | S | 7/2019 | Smalley | |
| 2003/0000182 | A1 | 1/2003 | Portrait et al. | |
| 2003/0098343 | A1 * | 5/2003 | Ross | B65D 75/06 229/103.2 |
| 2003/0132130 | A1 | 7/2003 | Bras | |
| 2004/0011674 | A1 | 1/2004 | Theelen | |
| 2004/0089671 | A1 | 5/2004 | Miller | |
| 2004/0099558 | A1 * | 5/2004 | Oliff | B65D 5/541 206/427 |
| 2004/0188277 | A1 | 9/2004 | Auclair | |
| 2004/0188300 | A1 * | 9/2004 | Sutherland | B65D 71/36 206/427 |
| 2004/0188301 | A1 | 9/2004 | Gomes | |
| 2004/0243277 | A1 | 12/2004 | Bonnain et al. | |
| 2004/0254666 | A1 | 12/2004 | Bonnain et al. | |
| 2005/0001020 | A1 | 1/2005 | Gamier | |
| 2005/0126947 | A1 * | 6/2005 | Holley, Jr. | B65D 71/36 206/427 |
| 2005/0178791 | A1 | 8/2005 | Miller | |
| 2005/0194430 | A1 | 9/2005 | Auclair et al. | |
| 2006/0191811 | A1 | 8/2006 | Fogle et al. | |
| 2006/0255108 | A1 | 11/2006 | Shmagin | |
| 2007/0080083 | A1 * | 4/2007 | Holley, Jr. | B65D 5/0227 206/434 |
| 2007/0158226 | A1 | 7/2007 | Coltri-Johnson et al. | |
| 2010/0108748 | A1 * | 5/2010 | Fleming | B65D 71/30 229/117.13 |
| 2010/0243720 | A1 * | 9/2010 | Adeline | B65D 77/0433 229/103.2 |
| 2011/0284403 | A1 | 11/2011 | Hendryx et al. | |
| 2017/0355501 | A1 | 12/2017 | Furio | |

FOREIGN PATENT DOCUMENTS

| | | |
|---|---|---|
| DE | 92 03 858.1 | 5/1992 |
| EP | 0 459 658 | 12/1991 |
| EP | 0 509 749 | 10/1992 |
| EP | 0520 411 | 12/1992 |
| EP | 0 360 643 B1 | 11/1993 |
| FR | 2 698 074 | 5/1994 |
| JP | 06-039764 U | 5/1994 |
| WO | WO 97/27124 | 7/1997 |
| WO | WO 02/102208 | 12/2002 |
| WO | WO 03/008292 | 1/2003 |
| WO | WO 2005/042370 | 12/2005 |
| WO | WO 2017/093702 A1 | 6/2017 |

OTHER PUBLICATIONS

Examination Report No. 1 for Standard Patent Application for AU 2019290523 dated Aug. 12, 2021.

Supplementary European Search Report for EP 19 82 2668 dated Mar. 2, 2022.

Examination Report No. 2 for Standard Patent Application for AU 2019290523 dated Feb. 25, 2022.

* cited by examiner

CARRIER, BLANK, AND METHOD OF FORMING A CARRIER

CROSS-REFERENCE TO RELATED APPLICATION

This application claims the benefit of U.S. Provisional Patent Application No. 62/687,480, filed on Jun. 20, 2018.

INCORPORATION BY REFERENCE

The disclosure of U.S. Provisional Patent Application No. 62/687,480, filed on Jun. 20, 2018, is hereby incorporated by reference for all purposes as if presented herein in its entirety.

BACKGROUND OF THE DISCLOSURE

The present disclosure relates to carriers, sleeves, or cartons, blanks for forming carriers, sleeves, or cartons, and methods associated with carriers, sleeves, or cartons and associated blanks for holding and carrying at least one article. In one embodiment, the present disclosure relates to a carrier or sleeve for holding and carrying at least one article.

SUMMARY OF THE DISCLOSURE

According to one aspect of the disclosure, a blank for forming a carrier for holding at least one article comprises a plurality of panels comprising a first main panel foldably connected to a second main panel. The first main panel comprises a top panel portion foldably connected to at least one top side panel portion, and the second main panel comprises a bottom panel portion foldably connected to at least one bottom side panel portion. The blank further comprises at least one handle feature for forming a handle.

According to another aspect of the disclosure, a method of forming a carrier for holding at least one article comprises obtaining a blank comprising a plurality of panels comprising a first main panel foldably connected to a second main panel. The first main panel comprises a top panel portion foldably connected to at least one top side panel portion, and the second main panel comprises a bottom panel portion foldably connected to at least one bottom side panel portion. The blank further comprises at least one handle feature.

According to another aspect of the disclosure, a carrier comprises a plurality of panels extending at least partially around an article receiving space, the plurality of panels comprising a top panel, a bottom panel, and at least one side panel. The carrier further comprises a handle and at least one bottom corner portion comprising a first layer of the at least one side panel, a second layer of the at least one side panel, and a third layer of the at least one side panel.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Carriers, sleeves, or cartons according to the present disclosure can accommodate one or more articles of numerous different shapes. For the purpose of illustration and not for the purpose of limiting the scope of the disclosure, the following detailed description describes articles such as a food product container that are at least partially disposed within the carton or carrier embodiments. The article can be used for packaging food and beverage products, for example. The article can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof. Further, the carrier of the present disclosure can hold more than one article, and the article(s) can be other types of articles (e.g., beverage bottles, cans, food trays, etc.) without departing from the disclosure.

In this specification, the terms "lower," "bottom," "upper," and "top" indicate orientations determined in relation to fully erected and upright cartons or carriers. As described herein, cartons or carriers may be formed from blanks by overlapping multiple panels or panel portions. Such panels and/or panel portions may be designated herein in terms relative to one another, e.g., "first", "second", "third", etc., in sequential or non-sequential reference, without departing from the disclosure.

Figure 1:
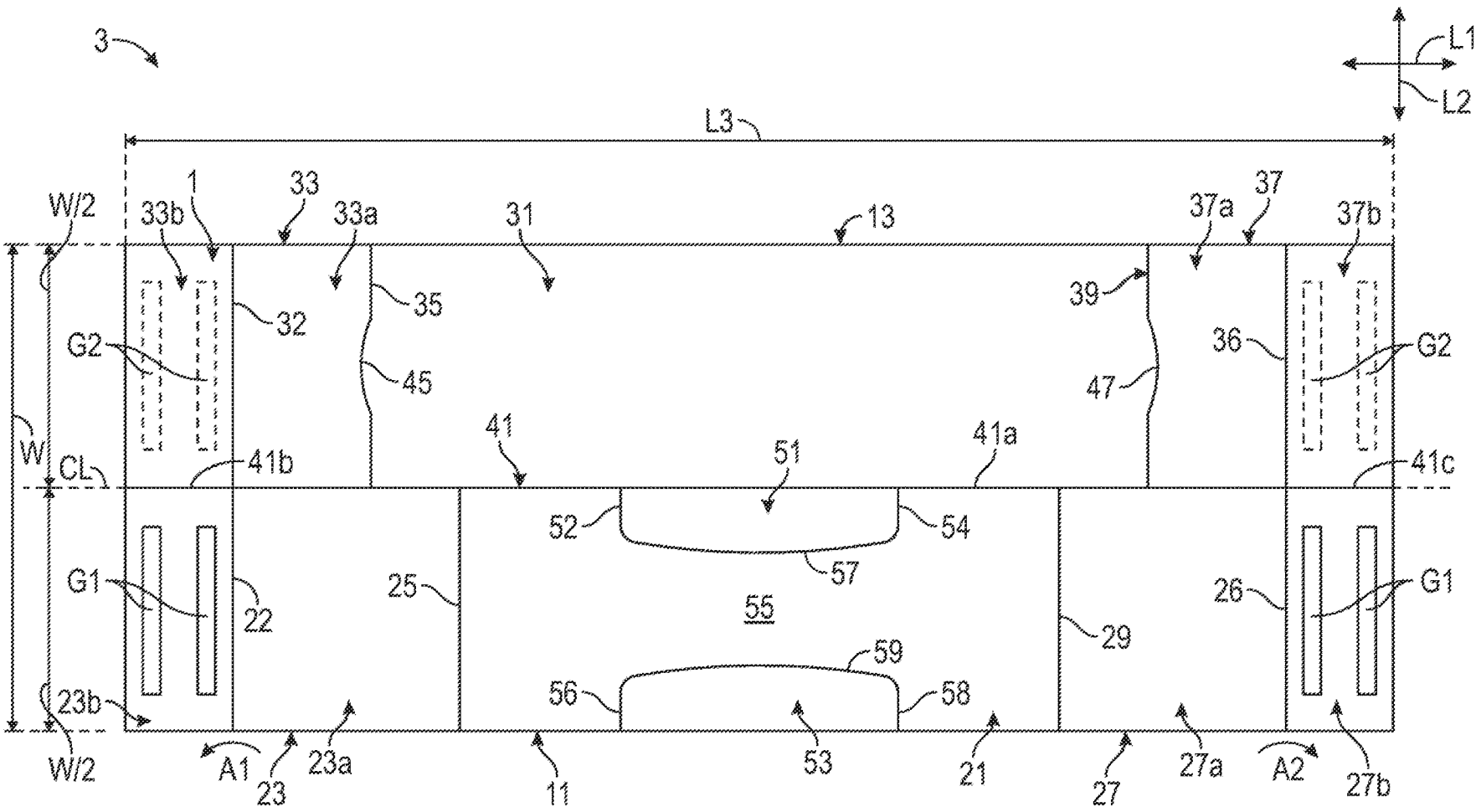
FIG. 1 is a plan view of an exterior surface of a blank for forming a carrier according to one exemplary embodiment of the disclosure.
Figure 6:
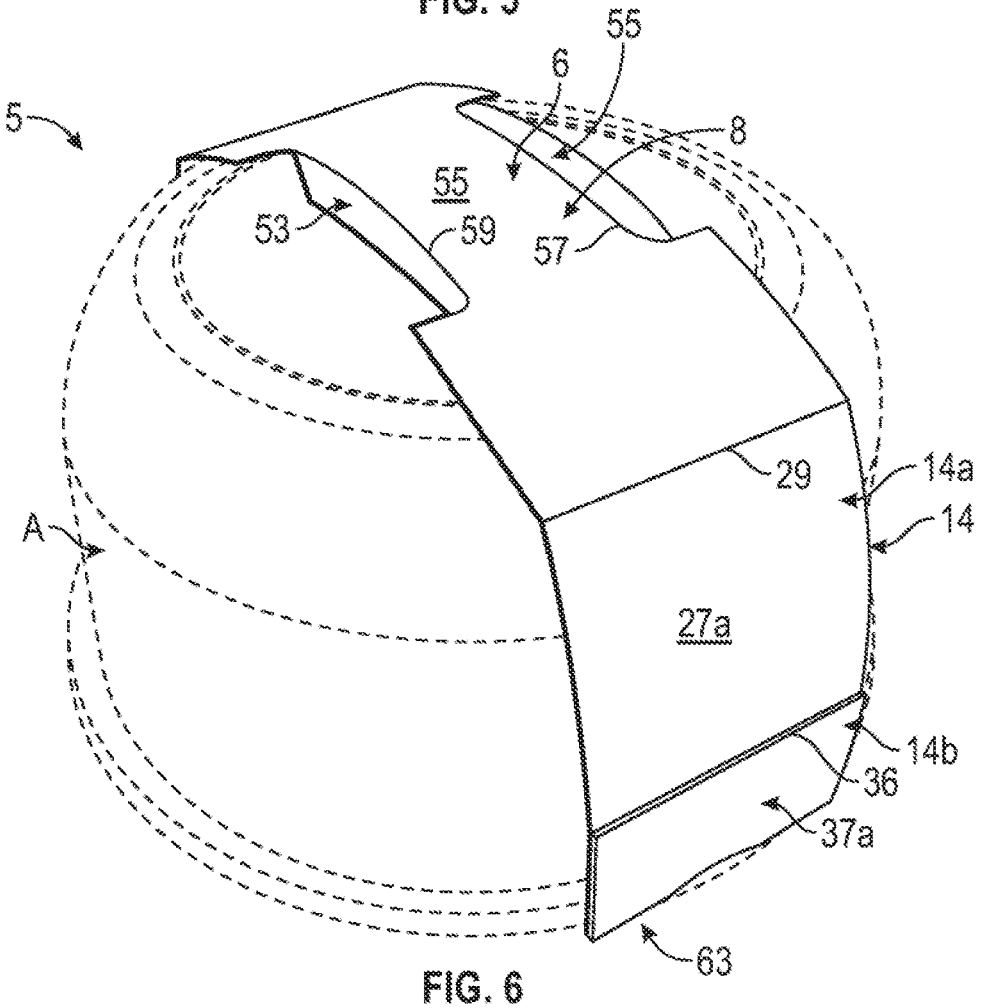
FIG. 6 is a perspective view of the carrier of FIG. 4 engaged with an article.

FIG. 1 is a plan view of an exterior surface 1 of a blank 3 that can be obtained for forming a carrier 5 (FIG. 4) according to a first exemplary embodiment of the disclosure. The carrier 5 can be used to hold at least one article A (FIG. 6), such as a food product container. As shown in FIG. 6, the carrier 5 is provided with a handle 6 that is positionable to facilitate carrying of the carrier 5 by a user. In one embodiment, the carrier 5 comprises a top panel 8, a bottom panel 10, a first side panel 12 foldably connected to the top panel 8 and the bottom panel 10, and a second side panel 14 foldably connected to the top panel 8 and the bottom panel 10. The carrier 5 can be referred to as a sleeve in that the panels 8, 10, 12, 14 wrap around the article A to secure the article A to the carrier 5.

As shown in FIG. 1, the blank 3 has a longitudinal axis L1 and a lateral axis L2. The blank 3 includes a first main panel 11 and a second main panel 13. In one embodiment, the first and second main panels 11, 13 are generally rectangular and have a length L3 in the longitudinal direction L1 corresponding to the length of the blank 3. The first main panel 11 includes a top panel portion 21, a first top side panel portion 23 foldably connected to the top panel portion 21 at a lateral fold line 25, and a second top side panel portion 27 foldably connected to the top panel portion 21 at a lateral fold line 29. The second main panel 13 comprises a bottom panel portion 31, a first bottom side panel portion 33 foldably connected to the bottom panel portion 31 at a lateral fold line 35, and a second bottom side panel portion 37 foldably connected to the bottom panel portion at a lateral fold line 39. The lateral fold lines 35, 39 of the second main panel 13, as shown, include a respective arcuate cut 45, 47. In one embodiment, the arcuate cuts 45, 47 can define respective protruding portions of the bottom panel portion 31 that provide stability to the erected carrier 5.

In one embodiment, the first main panel 11 is foldably connected to the second main panel 13 by a longitudinal line of weakening 41 extending along the length of the blank 3. As shown in FIG. 1, the first side panel portions 23, 33 each comprise a respective base portion 23*a*, 33*a*, and a respective distal portion 23*b*, 33*b* foldably connected to the respective base portion 23*a*, 33*a* at a respective lateral fold line 22, 32. The second side panel portions 27, 37 are identical to respective first side panel portion 23, 33 in that the second side panel portions 27, 37 have a respective base portion 27*a*, 37*a* and a distal portion 37*b*, 37*b* foldably connected to the respective base portion 27*a*, 37*a* by a respective lateral fold line 26, 36. In one embodiment, the line of weakening 41 is located on the lateral centerline CL of the blank 3 and comprises a middle tear line 41*a* and respective end portions 41*b*, 41*c* that are fold lines. In one embodiment, the first end portion 41*b* foldably connects the distal portions 23*b*, 33*b* of the respective first side panel portions 23, 33 of the respective first main panel 11 and the second main panel 13, and the second end portion 41*c* foldably connects the distal portions 27*b*, 37*b* of the respective second side panel portions 27, 37 of the respective first main panel 11 and the second main panel 13.

In addition, the top panel portion 21 of the first main panel 11 includes a handle panel 55 and handle flaps 51, 53 at least partially formed by respective lateral cuts 52, 54 and 56, 58, and foldably connected to the handle panel 55 at respective curved fold lines 57, 59. As shown, the handle panel 55 is at least partially defined between the handle flaps 51, 53. Features for forming the handle 6 of the carrier 5 comprise the handle flaps 51, 53, the handle panel 55, and the fold lines 57, 59.

As shown, the blank 3 has a blank length, e.g., measured from one lateral free edge of the blank 3 to the opposite lateral free edge of the blank 3, of L3 and a blank width, e.g., measured from one longitudinal free edge of the blank 3 to the opposite longitudinal free edge of the blank 3, of W. As shown, a lateral width of each of the first main panel 11 and the second main panel 13 can be approximately W/2 (broadly, respective "first width" and "second width"), i.e., approximately half the blank width W. In one embodiment, the blank length L3 is approximately 18.25 inches, the blank width W is approximately 7.0 inches, and the corresponding ratio R of blank length L3 to blank width W is approximately 2.6. A ratio of the blank length L3 to the blank width W can be in the range of approximately 1.0 to approximately 7.0, including integer and non-integer numbers therebetween, without departing from the scope of the disclosure.

The blank 3 can have other features and/or the features of the blank shown and described could be otherwise shaped, arranged, configured, and/or omitted without departing from the scope of the disclosure.

Figure 2:
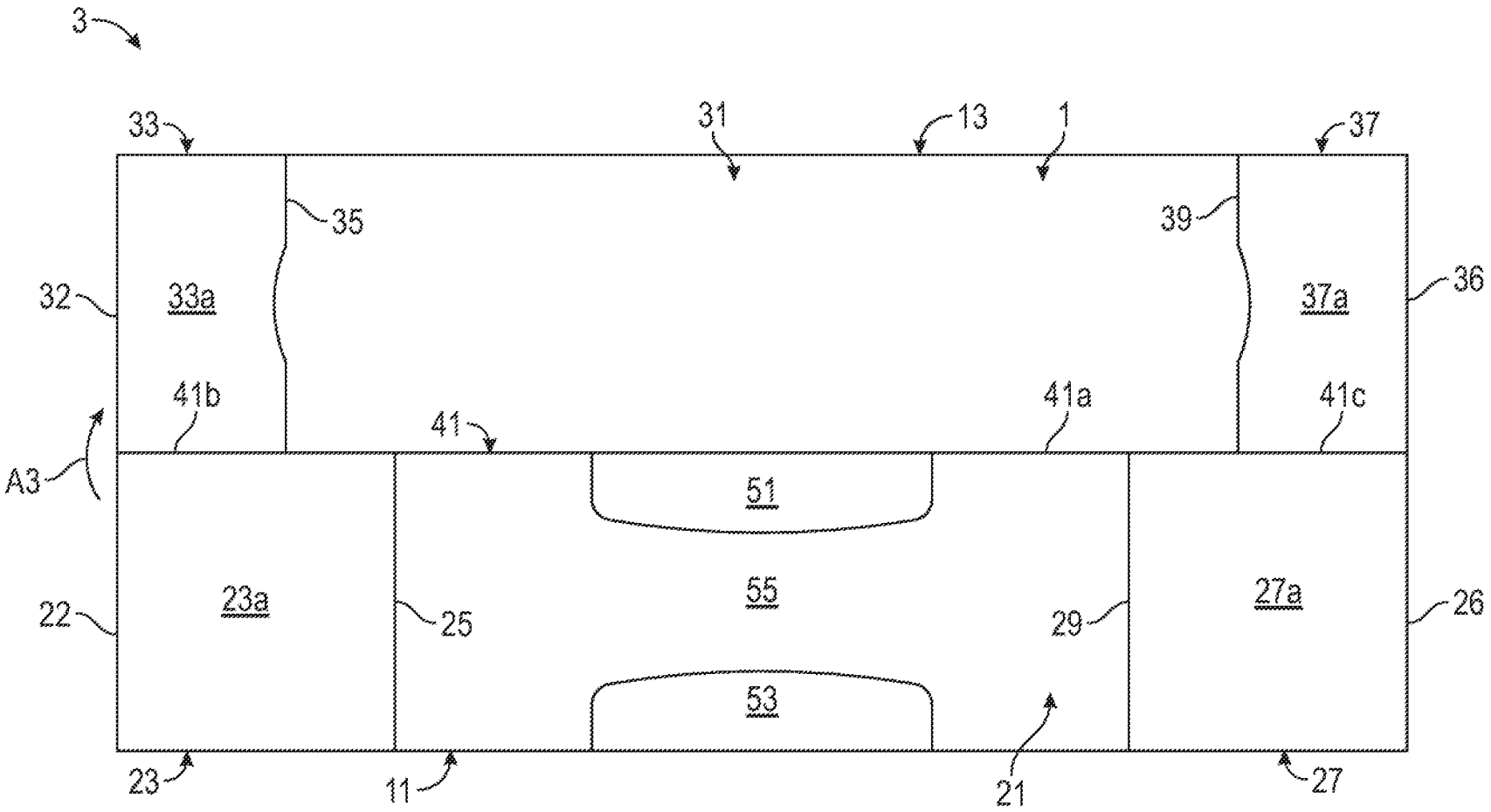
FIG. 2 is a plan view of a carrier formed from the blank of FIG. 1 in a partially folded configuration.
Figure 3:
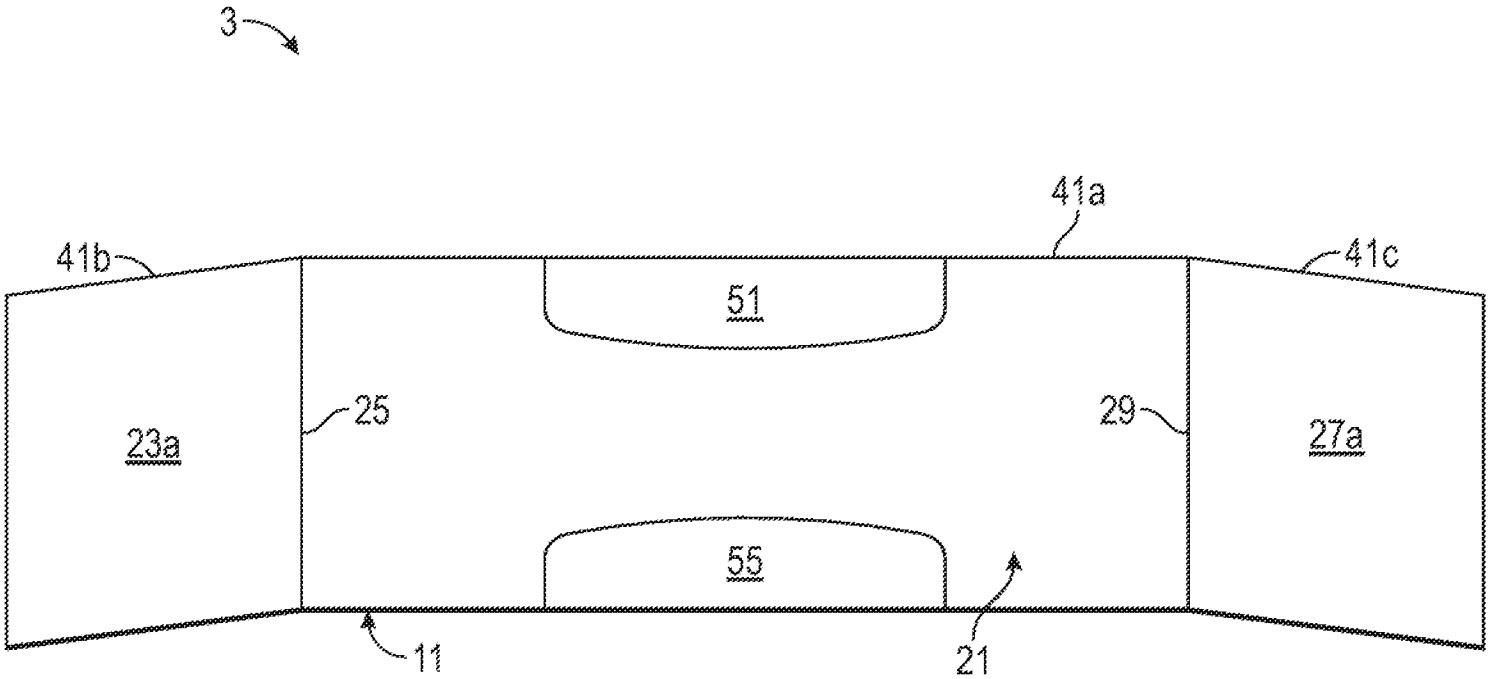
FIG. 3 is a perspective view of a carrier formed from the blank of FIG. 1 in a partially folded configuration.
Figure 4:
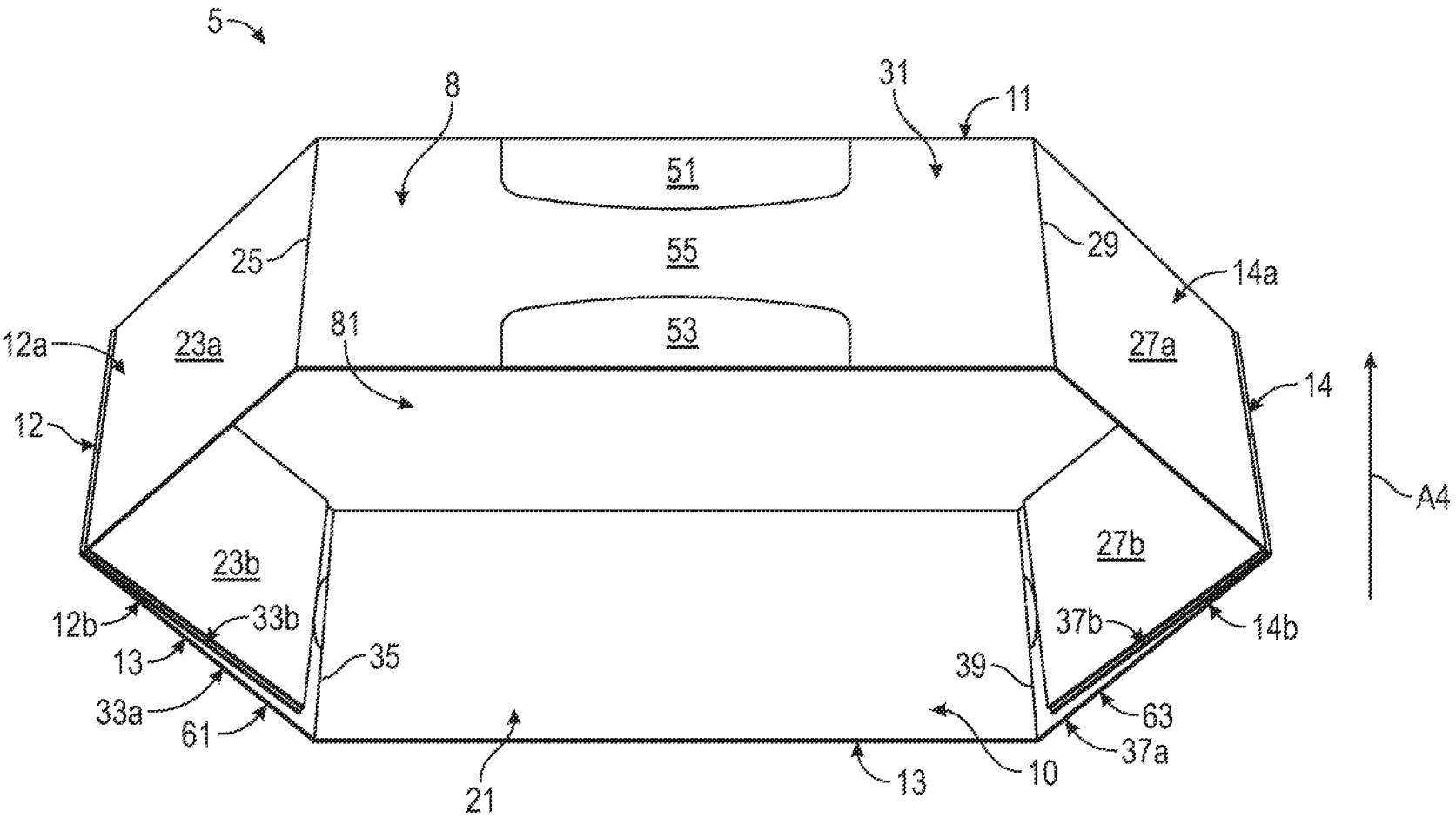
FIG. 4 is a perspective view of a carrier formed from the blank of FIG. 1.

Referring additionally to FIGS. 2-4, formation of the carrier 5 can be from the blank 3 according to one exemplary embodiment of the disclosure is illustrated. Glue G1 can be applied to the exterior surface of the blank 3 on the distal portions 23*b*, 27*b* of the first side panel portion 23 and the second side panel portion 27 of the first main panel 11, and glue G2 can be applied to the interior surface of the blank 3 on distal portion 33*b*, 37*b* of first side panel portion 33 and the second side panel portion 37 of the second main panel 13.

The distal portions 23*b*, 33*b* of the respective first side panel portions 23, 33 can be folded at the respective fold lines 22, 32 in the direction of the arrow A1 so that the distal portion 23*b* is in face-to-face contact with the base portion 23*a* of the first side panel portion 23 of the first main panel 11 and the distal portion 33*b* is in face-to-face contact with the base portion 33*a* of the first side panel portion 33 of the second main panel 13. The glue G2 on the interior surface of the distal portion 33*b* adheres the distal portion 33*b* to the base portion 33*a*. Similarly, the respective second side distal portions 27*b*, 37*b* can then be folded, or can be folded simultaneously, at the respective fold lines 26, 36 in the direction of arrow A2 so that the distal portion 27*b* is in face-to-face contact with the base portion 27*a* of the second side panel portion 27 of the first main panel 11 and the distal portion 37*b* is in face-to-face contact with the base portion 37*a* of the second side panel portion 37 of the second main panel 13. The glue G2 on the interior surface of the distal portion 37*b* adheres the distal portion 37*b* to the base portion 37*a*. FIG. 2 illustrates the blank 3 after the aforementioned foldings of the distal portions 23*b*, 33*b*, 27*b*, 37*b*.

As shown in FIGS. 2 and 3, the second main panel 13 can be folded at the respective portions 41*b*, 41*c* of the line of weakening 41 in the direction of the arrow A3 so that the second main panel 13 is folded under the first main panel 11 and is in face-to-face contact with the first main panel. The glue G1 on the exterior surface of the distal portion 23*b* of the first side panel portion 23 of the first main panel 11 and the glue G1 on the exterior surface of the distal portion 27*b* of the second side panel portion 27 of the first main panel 11 adheres the second main 13 panel in face-to-face contact with the first main panel 11. In particular, in such an arrangement, the exterior surfaces of the respective distal portions 33*b*, 37*b* of the respective side panel portions 33, 37 of the second main panel 13 are in at least partial face-to-face contact with and adhered to the respective exterior surfaces of the respective distal portions 23*b*, 27*b* of the respective side panel portions 23, 27 of the first main panel 13.

During the aforementioned folding of the second main side panel 13 at the end portions 41*b*, 41*c* of the line of weakening 41, the tear line portion 41*a* of the line of weakening 41 tears so that the first main panel 11 is not attached, e.g., is free from attachment, to the second main panel 13 along the tear line portion 41*a* of the line of weakening 41. FIG. 3 illustrates the blank 3 after the aforementioned foldings of the distal portions 23*b*, 27*b*, 33*b*, 37*b* and the second main panel 13.

As shown in FIG. 4, the carrier 5 is formed by raising the first main panel 11 relative to the second main panel 13, e.g., in the direction of the arrow A4, so that the top panel portion 21 of the first main panel 11 forms the top panel 8 of the carrier 5, the bottom panel portion 31 of the second main panel 13 forms the bottom panel 10 of the carrier 5, the first side panel portion 23 of the first main panel and the first side panel portion 33 of the second main panel 13 form the first side panel 12 of the carrier 5, and the second side panel portion 27 of the first main panel 11 and the second side panel portion 37 of the second main panel 13 form the second side panel 14 of the carrier 5. As shown, in the erected carrier 5, the top panel 8 is spaced apart from the bottom panel 10 by the first side panel 12 and the second side panel 14 to form or define an article-receiving space 81.

Figure 5:
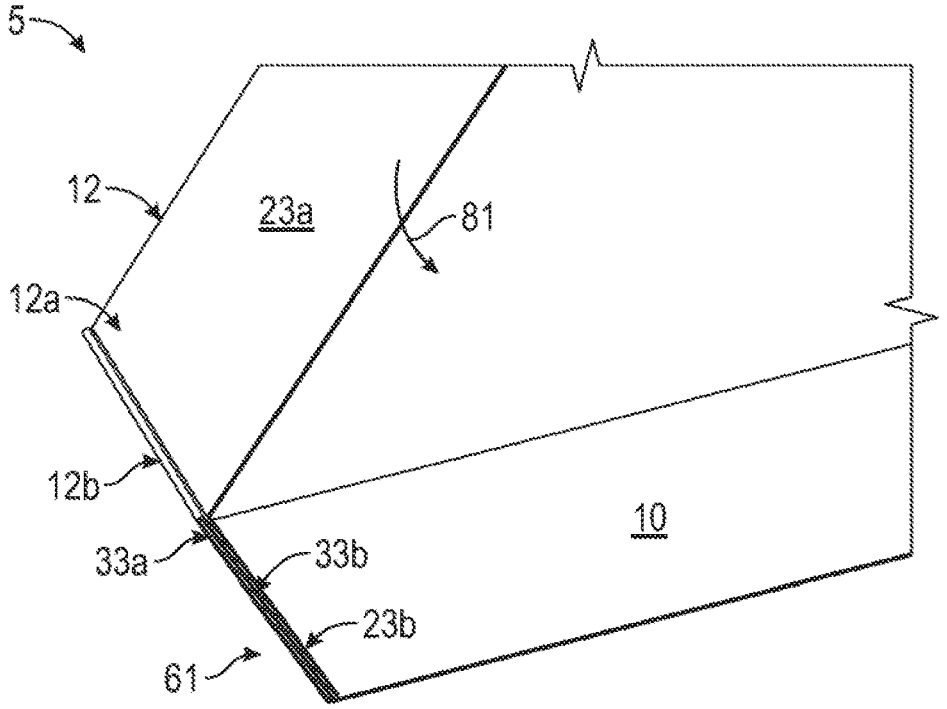
FIG. 5 is a detail view of a portion of the carrier of FIG. 4.

As shown in FIG. 5, the first side panel 12 of the carrier 5 has an upper portion 12*a* foldably connected to the top panel 8 at the fold line 25 and formed by the base portion 23*a* of the first side panel portion 23 of the first main panel 11, and a lower portion 12*b* foldably connected to the bottom panel 10 at the fold line 35 and comprising the distal portion 23*b* (broadly, "first layer of the first side panel") of the first side panel portion 23 of the first main panel 11, and the base portion 33*a* (broadly, "third layer of the first side panel") and the distal portion 33*b* (broadly, "second layer of the first side panel") of the first side panel portion 33 of the second main panel 13.

Similarly, the second side panel 14 of the carrier 5 has an upper portion 14*a* foldably connected to the top panel 8 at the fold line 29 and formed by the base portion 27*a* of the second side panel portion 27 of the first main panel 11, and a lower portion 14*b* foldably connected to the bottom panel 10 at the fold line 39 and comprising the distal portion 27*b* (broadly, "first layer of the second side panel") of the second side panel portion 27 of the first main panel 11, and the base portion 37*a* (broadly, "third layer of the second side panel") and the distal portion 37*b* (broadly, "second layer of the second side panel") of the second side panel portion 37 of the second main panel 13.

As such, each of the lower portions 12*b*, 14*b* of the side panels 12, 14 comprises three layers of material in at least partial face-to-face contact, e.g., in a triple ply or three ply configuration, to provide reinforcement to the carrier 5. In particular, the lower portions 12*b*, 14*b* of the respective side panel 12, 14 form respective first and second bottom corner portions 61, 63 of the carrier 5 that can engage an article A. The carrier 5 could be formed by other methods and steps without departing from the scope of the disclosure.

Referring additionally to FIG. 6, the carrier 5 can be placed around an article A, with the article A being inserted into the article receiving space 81 and secured thereto. For example, the carrier 5 can be arranged so as to at least partially surround the article A and exert a compressive force therearound to maintain a secure coupling of the carrier 5 and the article A positioned therein. In one embodiment, the carrier 5 can maintain an integrity or arrangement of the article A, for example, where the article A comprises a tray or base and a removable lid or cover, such as in a frozen food package for ice cream or ice cream products such as an ice cream cake. It will be understood that various portions of the carrier 5 can be flexibly reconfigurable and/or reconfigurable at one or more fold lines to accommodate articles of varying sizes and shapes.

The handle 6, as shown, can be formed by activating the handle features 51, 52, 53, 54, 55, 56, 57, 58, 59, so that the carrier 5 can be used to carry the article A. For example, the handle panel 55 can be grasped at the palm of a consumer's hand, and the handle flaps 51, 53 can be separated from the handle panel 55/top panel 10 at the respective cuts 52, 54 and 56, 58 and folded downwardly at the respective fold lines 57, 59, e.g., by the customer's fingers, so that an ergonomic grip can be provided for the customer. In one embodiment, one or both of the handle flaps 51, 53 can overlap the handle panel 55 to provide a structure with a two-ply configuration.

The blank 3 of the present disclosure having the first and second main panels 11, 13 with a blank length L3 equal to the longitudinal length of the blank 3 and a blank width W equal to the lateral width of the blank 3 can be more easily formed into the carrier 5 than other configurations of blanks, for example, a blank with a longer length and a shorter width, e.g., a blank having a smaller length to width ratio. For example, the configuration of the blank 3 reduces or eliminates alignment or skew issues that can occur with a gluing apparatus that receives the blank 3. The blank 3 having a blank length L3 to blank width W ratio of approximately 2.6 allows for more efficient and accurate formation of the carrier 5 from the blank 3 in the gluing apparatus. Such configuration of the blank 3 is facilitated by the laterally adjacent positioning of the main panels 11, 13 prior to the folding operations described above, e.g., so that the blank 3 is provided with the disclosed blank length to blank width ratio for gluing operations, and which ratio can subsequently be increased upon folding of the blank.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carrier to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton or carrier embodiments. The term "glue" is intended to encompass all manner of adhesives commonly used to secure carton or carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A blank for forming a carrier for holding at least one article, the blank comprising:

a plurality of panels comprising a first main panel foldably connected to a second main panel at a longitudinal line of weakening, the first main panel comprises a top panel portion foldably connected to at least one top side panel portion, the second main panel comprises a bottom panel portion foldably connected to at least one bottom side panel portion, the longitudinal line of weakening comprises a tear line separably connecting the top panel portion and the bottom panel portion; and at least one handle feature for forming a handle, the at least one handle feature comprising a handle panel in the top panel portion.

2. The blank of claim 1, wherein the first main panel and the second main panel are generally rectangular and have a length corresponding to the length of the blank.

3. The blank of claim 1, wherein the first main panel and the second main panel define a blank length and a blank width of the blank, a ratio of the blank length to the blank width is in a range of approximately 1.0 to approximately 7.0.

4. The blank of claim 3, wherein the ratio of the blank length to the blank width is approximately 2.6.

5. The blank of claim 1, wherein the first main panel has a first width and the second main panel has a second width, the blank has a blank width, and each of the first width and the second width is approximately half the blank width.

6. The blank of claim 1, wherein at least one of the at least one top side panel portion and the at least one bottom side panel portion comprises a base portion foldably connected to a distal portion.

7. The blank of claim 6, wherein each of the at least one top side panel portion and the at least one bottom side panel portion comprises the respective base portion and the respective distal portion.

8. The blank of claim 7, wherein the base portion of the at least one top side panel portion is foldably connected to the top panel portion and the base portion of the at least one bottom side panel portion is foldably connected to the bottom panel portion.

9. The blank of claim 8, wherein the at least one top side panel portion is a first top side panel portion and the first main panel further comprises a second top side panel portion, and the at least one bottom side panel portion is a first bottom side panel portion and the second main panel further comprises a second bottom side panel portion.

10. The blank of claim 1, wherein the longitudinal line of weakening comprises a first end portion foldably connecting the distal portion of the first top side panel portion and the distal portion of the first bottom side panel portion, and the longitudinal line of weakening comprises a second end portion foldably connecting the distal portion of the second top side panel portion and the distal portion of the second bottom side panel portion.

11. The blank of claim 9, wherein the top panel portion is for forming a top panel of the carrier formed from the blank, the bottom panel portion is for forming a bottom panel of the carrier formed from the blank, the first top side panel portion and the first bottom side panel portion are for forming a first side panel of the carrier formed from the blank, and the second top side panel portion and the second bottom side panel portion are for forming a second side panel of the carrier formed from the blank.

12. The blank of claim 11, wherein the base portion of the first bottom side panel portion, the distal portion of the first bottom side panel portion, and the distal portion of the first top side panel portion are positioned for being in at least partial face-to-face contact to form a first bottom corner portion of the carrier formed from the blank, and the base portion of the second bottom side panel portion, the distal portion of the second bottom side panel portion, and the distal portion of the second top side panel portion are positioned for being in at least partial face-to-face contact to form a second bottom corner portion of the carrier formed from the blank.

13. The blank of claim 1, wherein the at least one handle feature further comprises at least one handle flap foldably connected to the handle panel.

14. A carrier formed from the blank of claim 1.

15. A method of forming a carrier for holding at least one article, the method comprising:

obtaining a blank comprising a plurality of panels comprising a first main panel foldably connected to a second main panel at a longitudinal line of weakening, the first main panel comprises a top panel portion foldably connected to at least one top side panel portion, the second main panel comprises a bottom panel portion foldably connected to at least one bottom side panel portion, the longitudinal line of weakening comprises a tear line separably connecting the top panel portion and the bottom panel portion, and at least one handle feature, the at least one handle feature comprising a handle panel in the top panel portion.

16. The method of claim 15, further comprising folding the plurality of panels to form the carrier.

17. The method of claim 15, wherein the first main panel and the second main panel are generally rectangular and have a length corresponding to the length of the blank.

18. The method of claim 15, wherein the first main panel and the second main panel define a blank length and a blank width of the blank, a ratio of the blank length to the blank width is in a range of approximately 1.0 to approximately 7.0.

19. The method of claim 18, wherein the ratio of the blank length to the blank width is approximately 2.6.

20. The method of claim 15, wherein the first main panel has a first width and the second main panel has a second width, the blank has a blank width, and each of the first width and the second width is approximately half the blank width.

21. The method of claim 15, wherein at least one of the at least one top side panel portion and the at least one bottom side panel portion comprises a base portion foldably connected to a distal portion.

22. The method of claim 21, wherein each of the at least one top side panel portion and the at least one bottom side panel portion comprises the respective base portion and the respective distal portion.

23. The method of claim 22, wherein the base portion of the at least one top side panel portion is foldably connected to the top panel portion and the base portion of the at least one bottom side panel portion is foldably connected to the bottom panel portion.

24. The method of claim 23, wherein the at least one top side panel portion is a first top side panel portion and the first main panel further comprises a second top side panel portion, and the at least one bottom side panel portion is a first bottom side panel portion and the second main panel further comprises a second bottom side panel portion.

25. The method of claim 15, wherein the longitudinal line of weakening comprises a first end portion foldably connecting the distal portion of the first top side panel portion and the distal portion of the first bottom side panel portion, and the longitudinal line of weakening comprises a second end portion foldably connecting the distal portion of the second top side panel portion and the distal portion of the second bottom side panel portion.

26. The method of claim 24, further comprising folding the plurality of panels to form the carrier such that the top panel portion forms a top panel of the carrier, the bottom panel portion forms a bottom panel of the carrier, the first top side panel portion and the first bottom side panel portion form a first side panel of the carrier, and the second top side panel portion and the second bottom side panel portion form a second side panel of the carrier.

27. The method of claim 26, wherein the base portion of the first bottom side panel portion, the distal portion of the first bottom side panel portion, and the distal portion of the first top side panel portion are in at least partial face-to-face contact to form a first bottom corner portion of the carrier, and the base portion of the second bottom side panel portion, the distal portion of the second bottom side panel portion, and the distal portion of the second top side panel portion are in at least partial face-to-face contact to form a second bottom corner portion of the carrier.

28. The method of claim 15, wherein the at least one handle feature further comprises at least one handle flap foldably connected to the handle panel.

* * * * *